US006715556B2

(12) United States Patent
Mack et al.

(10) Patent No.: US 6,715,556 B2
(45) Date of Patent: Apr. 6, 2004

(54) GAS RESTRICTOR FOR HORIZONTALLY ORIENTED WELL PUMP

(75) Inventors: John J Mack, Tulsa, OK (US); Brown L. Wilson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 33 days.

(21) Appl. No.: 10/244,252

(22) Filed: Sep. 16, 2002

(65) Prior Publication Data

US 2003/0079882 A1 May 1, 2003

Related U.S. Application Data

(60) Provisional application No. 60/335,955, filed on Oct. 30, 2001.

(51) Int. Cl.[7] ..... E21B 43/38
(52) U.S. Cl. ..... 166/369; 166/105; 166/105.5
(58) Field of Search ..... 166/50, 369, 68, 166/105, 105.5

(56) References Cited

U.S. PATENT DOCUMENTS 5,113,937 A * 5/1992 Cholet ..... 166/105.5

* cited by examiner

*Primary Examiner*—William Neuder
(74) *Attorney, Agent, or Firm*—Bracewell & Patterson, L.L.P.

(57) ABSTRACT

An intake assembly for a well pump restricts gas entry into the pump when the pump is located in a horizontal section of the well bore. The restrictor is located within a tubular intake housing. The intake housing has apertures for receiving the flow of well fluid. The apertures are spaced circumferentially around the housing. Once installed in the well, some of the apertures will be at higher elevations than others. The restrictor partially blocks at least one of the higher elevation apertures and opens at least one of the lower elevation apertures. The gas will be at the higher elevations, thus it is restricted from flowing in through the higher elevation aperture while the liquid freely flows into the lower elevation aperture. The restrictor may be of a buoyant material to float upward in the well fluid. The restrictor may also be open in response to contact with the casing wall.

19 Claims, 4 Drawing Sheets

GAS RESTRICTOR FOR HORIZONTALLY ORIENTED WELL PUMP

CROSS-REFERENCE TO RELATED APPLICATION

Applicants claim the benefit of provisional application Ser. No. 60/335,955 filed Oct. 30, 2001.

FIELD OF THE INVENTION

This invention relates in general to well pumps, and in particular to a restrictor device that restricts entry of gas into the intake of a horizontally oriented pump.

BACKGROUND OF THE INVENTION

Submersible well pumps are frequently employed for pumping well fluid from lower pressure oil wells. One type of pump comprises a centrifugal pump that is driven by a submersible electrical motor. The pump has a large number of stages, each stage comprising a diffuser and an impeller. Another type of pump, called progressive cavity pump, rotates a helical rotor within an elastomeric helical stator. In both types, the motor for driving the pump is typically an electrical motor submerged with the pump. Centrifugal pumps are normally used for pumping higher volumes of well fluid than progressive cavity pumps.

Both types of pumps become less efficient when significant amounts of gas from the well fluid flow into the intakes. Any gas in the well fluid tends to flow upward to the higher side of the casing. A pocket of free gas may form in the upper portion of the horizontal casing. The free gas tends to flow into the portion of the intake on the higher side of the pump.

SUMMARY OF THE INVENTION

The pump intake of this invention has a tubular housing with a plurality of apertures for receiving well fluid. The apertures are spaced circumferentially around the housing. Once installed in a horizontal portion of the well, the pump will be located on a lower side of the well casing. At least one of the apertures will be located at a higher elevation than the other apertures. The higher elevation aperture would be exposed to well fluid that has a higher gas content, or it may be entirely gas. The lower elevation aperture would be exposed to higher liquid content of well fluid.

A restrictor is located within the housing for partially blocking the higher elevation aperture. The restrictor also opens the lower elevation aperture to allow liquid to flow into the lower elevation aperture. The partial blocking of the higher elevation aperture restricts the entry of gas into the intake assembly housing.

The restrictor automatically moves into a position blocking the higher elevation aperture during installation of the pump. In the first embodiment, the restrictor is buoyant in the well fluid. The buoyancy causes the restrictor to rise from a lower side of the intake assembly to an upper side at least partially blocking the higher elevation aperture and freeing the lower aperture from blockage.

In the second and third embodiments, the restrictor moves out of engagement with the lower elevation aperture in response to the housing coming into contact with the lower wall of the well casing. This movement is handled by one or more pins that protrude through holes in the housing. The restrictor is flexible, and when a pin contacts the lower side of the casing, it flexes a portion of the restrictor upward to open the lower aperture for receiving well fluid. The upper aperture remains blocked due to a bias of the restrictor against the sidewall of the housing.

DETAILED DESCRIPTION OF THE PREFERRED EMBODIMENT

Figure 1A:
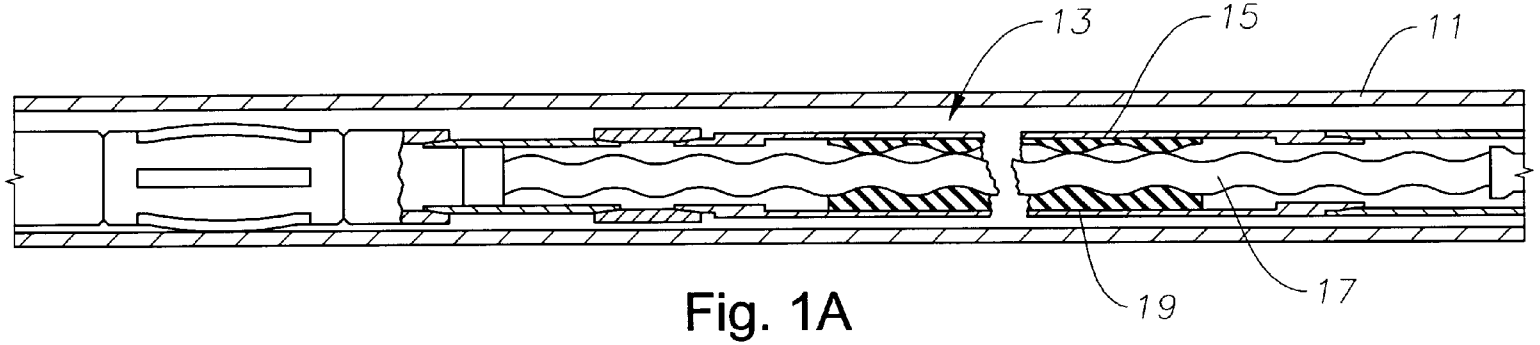
FIGS. 1A and 1B comprise a vertical sectional view of a well pump having an intake assembly in accordance with this invention.

Referring to FIG. 1, a horizontal section of a casing 11 has an upper portion that extends vertically from the surface into a gradual bend and then into a horizontal section. A pump assembly 13 is shown installed in the horizontal portion of casing 11. Pump assembly 13 has a pump 15, which in this embodiment is shown to be a progressive cavity pump. Pump 15 has a metal helical rotor 17 that is rotated within an elastomeric stator 19 that has double helix cavities formed therein. A shaft 21 joins the lower end of rotor 17 with a motor assembly 23. Pump 15 could alternately be a centrifugal pump having a plurality of stages of impellers and diffusers. Motor assembly 23 preferably includes an electrical motor that is driven by power supplied through a power cable that leads to the surface.

An intake housing 25 is attached to the lower end of the housing of pump 15. Intake housing 25 could be integrally formed as a part of the housing of pump 15, rather than being secured as shown. Intake housing 25 is a tubular member having at least two apertures 27 spaced circumferentially from each other in housing 25. Apertures 27 are elongated slots that are parallel with the axis of shaft 21. Alternately, aperture 27 could be of other configurations, including circular holes. Shaft 21 is supported on bearings 28 located within and at the ends of intake housing 25.

Figure 1B:
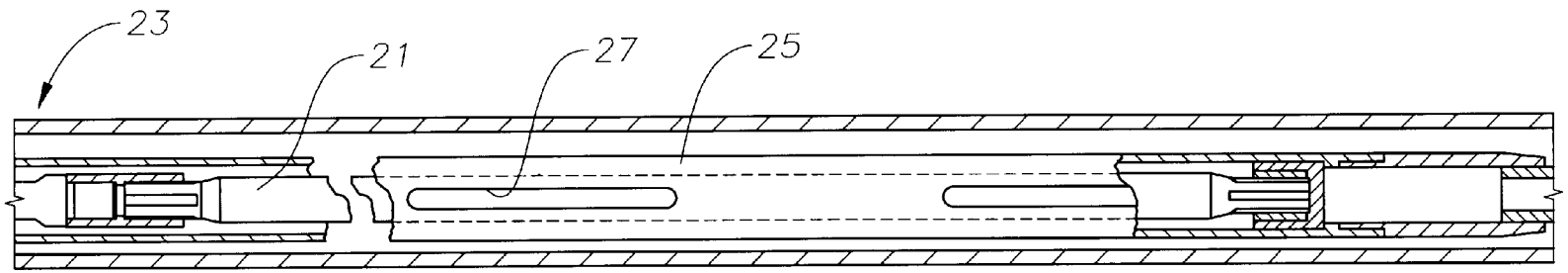
Figure 2:
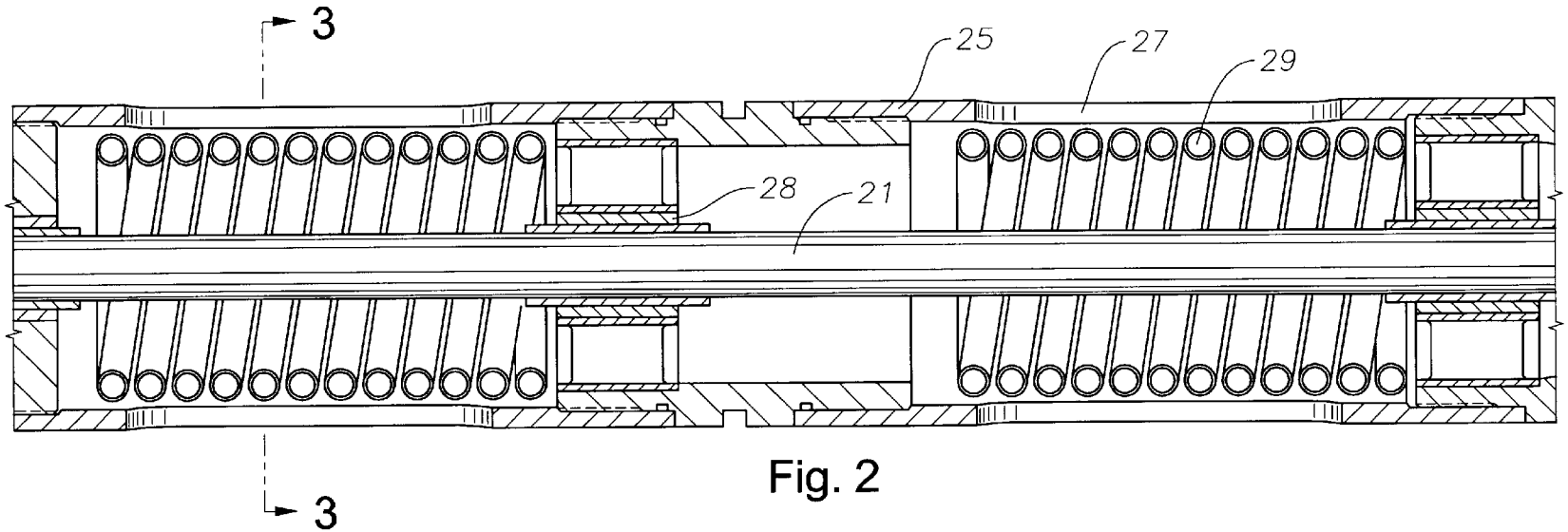
FIG. 2 is an enlarged sectional view of the intake assembly of the well pump of FIG. 1.
Figure 3:
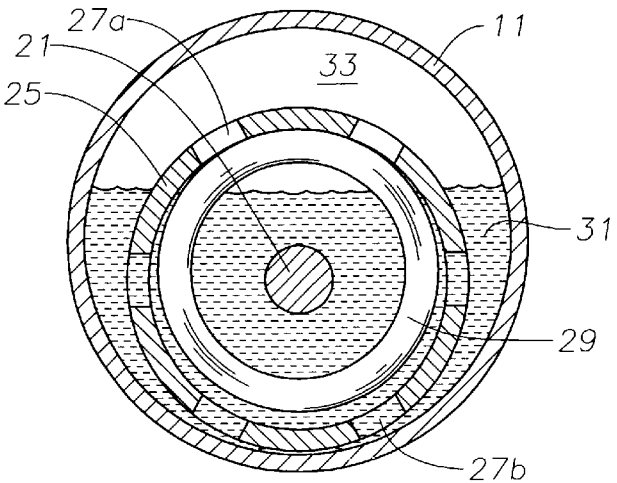
FIG. 3 is a sectional view of the intake assembly of FIG. 2, taken along the line 3—3 of FIG. 2.

Apertures 27 are spaced apart from each other circumferentially around intake housing 25, as shown in FIG. 3. FIG. 3 shows six different apertures 27 spaced circumferentially apart from each other, but the number could differ. Also, as shown in FIGS. 1B and 2, in this embodiment, there are two sets of apertures 27, one set of six being located closer to pump 15, and the other set of six being located closer to motor assembly 23. The length of intake housing 25 could be longer or shorter, resulting a different number of sets of apertures 27.

When pump assembly 13 is lowered into the well, it may rotate some as it moves through casing 11. It is difficult to determine at the surface which of the apertures 27 will be on the low side of casing 11 and which would be on the high side of casing 11. However, it is not necessary to know the particular orientation in advance. Regardless, at least one of the apertures 27 will be at a higher elevation than at least one other aperture 27. For convenience herein, the two apertures 27*a* located in an area 33 that contains free gas will be considered higher elevation apertures, and the four apertures 27*b* located in the area 31 that is principally liquid will be consider lower elevation apertures.

One or more restrictors 29 are located within intake housing 25 to at least partially block one or more of the higher elevation apertures 27*a* and open at least one of the lower elevation apertures 27*b*. In the first embodiment, restrictor 29 comprises a pair of buoyant elements, each aligning longitudinally with one of the sets of apertures 27. In the embodiment shown in FIG. 2, bearing 28 is located between the two restrictors 29, however it could be eliminated and a single longer restrictor 29 utilized in some cases. Restrictor 29 is preferably a helical coil of buoyant material. The turns of restrictor 29 may be solid and filled or made with a buoyant foam. Alternately, the turns of restrictor 29 could be hollow and sealed. The outer diameter of restrictor 29 is less than the inner diameter of intake housing 25 by a clearance. The length of restrictor 29 is preferably slightly longer than the lengths of apertures 27.

The smaller diameter of restrictor 29 enables it to float upward to the position shown in FIG. 3. In the position shown in FIG. 2, restrictor 29 is shown concentric with shaft 21, which extends through it. The position shown in FIG. 2 would exist only when pump assembly 13 (FIG. 1) is suspended vertically. In FIG. 3, intake housing 25 is shown located on the lower side of casing 11 due to the horizontal portion of casing 11. Restrictor 29 has floated upward into contact with the upper side of intake housing 25. Consequently, when in the upper position, it will partially block the two elevated apertures 27*a* that are located in gas 33 above liquid 31. The separate turns of restrictor 29 need not touch each other and need not form a complete seal over any of the apertures 27. Their purpose is to provide at least a partial block for reducing the entry of gas 33 into intake housing 25.

In the operation of the embodiment of FIGS. 1–3, pump assembly 13 is suspended on a production tubing and lowered into the well into a horizontal section of casing 11. Motor assembly 23 is supplied with electrical power, which drives shaft 21 and rotor 17. Well fluid 31 that has a high liquid content flows into all of the lower elevation apertures 27*b* because they are not blocked by buoyant restrictor 29. Well fluid 31 flows from intake housing 25 into the upstream end of pump 15. Partial blockage occurs of some of the upper elevated apertures 27*a*, inhibiting the entry of gas 33 into intake housing 25. Even if casing 11 is completely filled with liquid 31, and there is no free gas 33, gas bubbles will migrate toward the upper portion and be inhibited from entering upper elevation apertures 27*a*.

Figure 4:
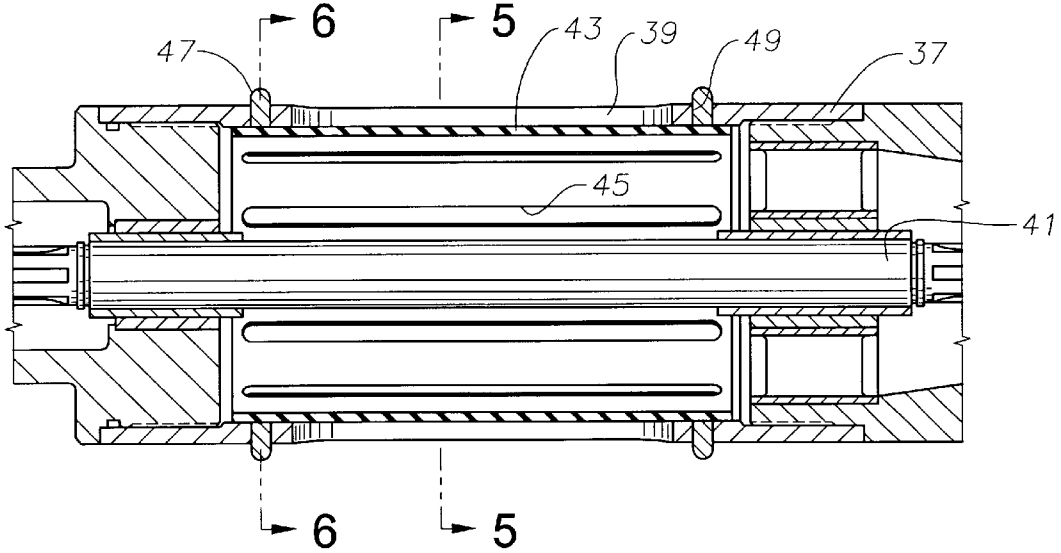
FIG. 4 is an enlarged sectional view of an alternate embodiment of an intake assembly for the well pump of FIG. 1.
Figure 6:
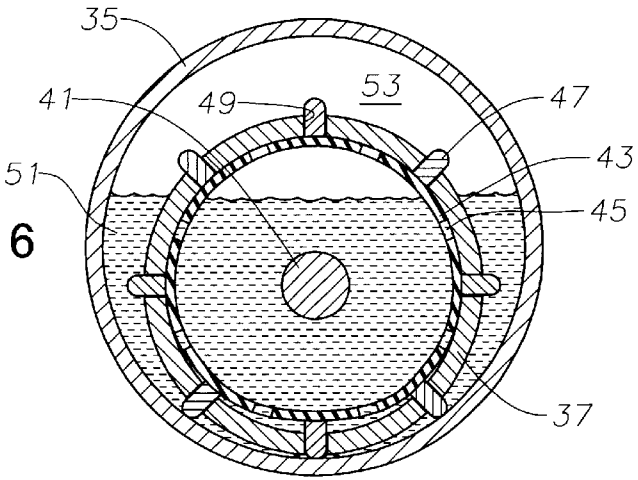
FIG. 6 is a sectional view of the intake assembly of FIG. 4, taken along the line 6—6 of FIG. 4 and shown within casing in a horizontal portion of a well.
Figure 5:
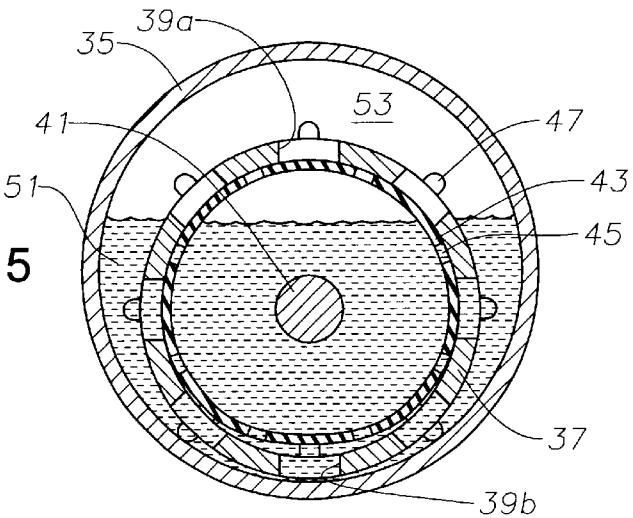
FIG. 5 is a sectional view of the intake assembly of FIG. 4, taken along the line 5—5 of FIG. 4 and shown within casing in a horizontal portion of a well.

FIGS. 4–6 illustrate a second embodiment of an intake assembly located within a horizontal section of a well casing 35 (FIG. 6). Intake housing 37 is tubular and has at least one set of elongated apertures 39 as in the first embodiment. Also, as in the first embodiment, there could be two or more sets of elongated apertures 39, although only one set is shown. Each set comprises at least two apertures 39 spaced circumferentially from each other around housing 37. In this embodiment, eight elongated apertures 39 are shown. Shaft 41 extends concentrically through intake housing 37 for driving a pump (not shown).

A restrictor 43 is located within intake housing 37, encircling shaft 41. In this embodiment, restrictor 43 comprises a sleeve that is flexible, and preferably of elastomeric material. Restrictor 43 could also be a split sleeve of flexible metallic material so that it has very low hoop strength. Restrictor 43 is sized so that it is biased against the inner side of intake housing 37 in contact and blocking apertures 39. Restrictor 43 has a plurality of slots 45, which are also shown to be elongated. Slots 45 are offset circumferentially from apertures 39 and do not need to have the same dimensions as apertures 39. In this embodiment, one slot 45 is located between each two of the apertures 39.

A set of pins 47 is located at each end of restrictor 43. Pins 47 are protuberances that protrude through holes 49 located in housing 37, and may be a variety of shapes. Each pin 47 is shown to be longitudinally aligned with one of the apertures 39 in intake housing 37, however this is not required. In this embodiment, eight pins 47 are shown in each set, each equally circumferentially spaced from the other around the intake housing 37.

Pins 47 protrude outward from housing 37 a selected distance. As illustrated in FIG. 6, the pins 47 on the lower side of intake housing 37 will deflect radially inward at least partially due to contact with the lower side of casing 35. One pin 47 is shown fully deflected inward while two pins are shown partially deflected inward. The deflection of at least one pin 47 causes part of restrictor 43 to deflect inward from contact with housing 37. The weight of intake housing 37 and other components of the pump as well as the flexibility of restrictor 43 causes this deflection.

When deflected inward, that portion of restrictor 43 moves away from engagement with the lower elevation apertures 39*b*. The upper elevation apertures 39*a* remain sealed due to the biased engagement of restrictor 43. This allows well fluid to flow in through lower elevation apertures 39*b*, then through at least some of the slots 45 and into the interior of intake housing 25. The well fluid flows forward from intake housing 37 into the upstream end of the pump (not shown). As in the first embodiment, it is not necessary for the operator to know which of the apertures 39 will be located on the upper side prior to lowering the pump assembly into the well.

Figure 7:
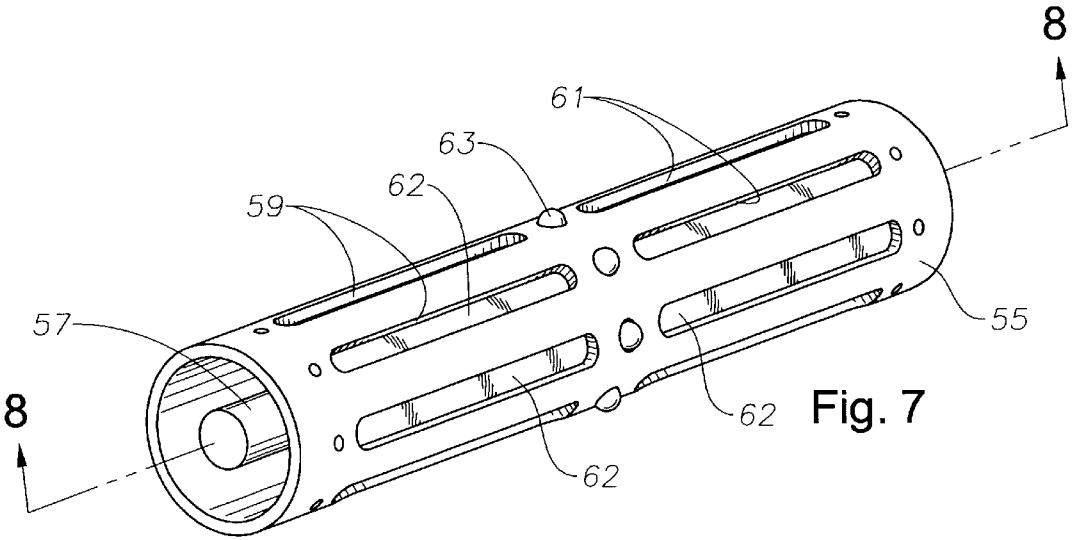
FIG. 7 is perspective view of a second alternate embodiment of an intake assembly for the well pump of FIG. 1.
Figure 8:
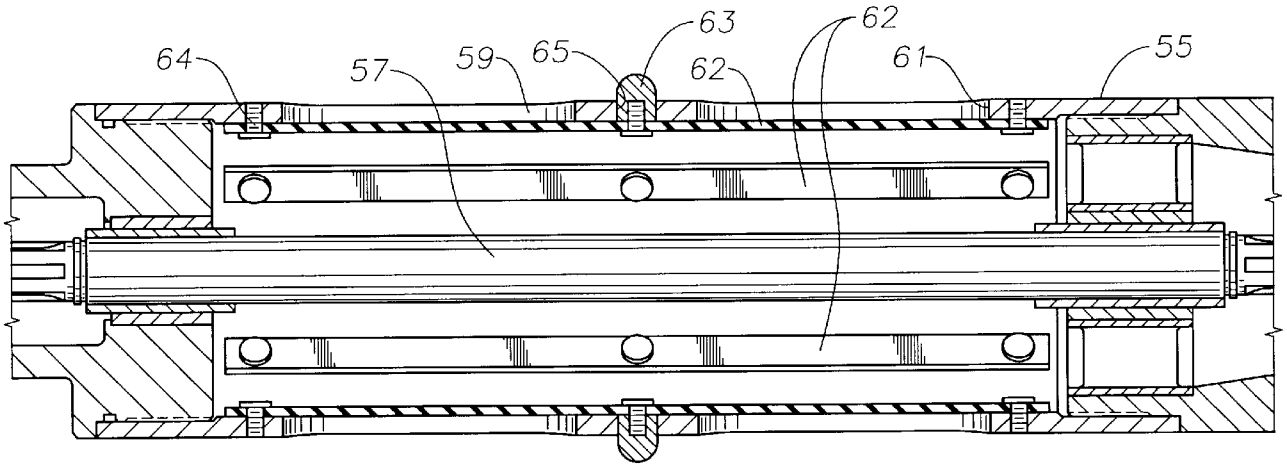
FIG. 8 is a partial sectional view of the intake assembly of FIG. 7, taken along line 8—8 of FIG. 7.

FIGS. 7 and 8 illustrate a third embodiment. In this embodiment, intake housing 55 is a tubular cylindrical member as in the other embodiments. Intake housing 55 encircles shaft 57, which rotates the pump (not shown). Two sets of apertures 59, 61 are shown. Each set of apertures 59, 61 comprises a plurality of elongated openings that are parallel to the axis of shaft 57. The apertures within each set of apertures 59 or 61 are circumferentially spaced apart from each other as in the other embodiments.

A separate restrictor 62 is secured to the inner side of intake housing 55 over each of the apertures 59,61. Each restrictor 62 is an elastomeric strip that has a length slightly greater than the combined lengths of apertures 59, 61. The width of each restrictor 62 is slightly greater than the width of each aperture 59, 61. Each restrictor 62 is secured by fasteners 64 at its opposite ends to hold it in an overlying, blocking contact with one aperture 59 and one of the apertures 61. In this embodiment, there are six apertures 59 and six apertures 61, thus there are six separate restrictors 62.

A pin 63 protrudes radially outward from each restrictor 62 through a hole 65 provided in intake housing 55. In the preferred embodiment, pin 63 is equally spaced between apertures 59 and 61, as well as being equally spaced between fasteners 64. One or more pins 63 are adapted to come into contact with the lower side of a well bore casing (not shown). The contact with the casing causes one of the pins 63 to move inward, deflecting one of the restrictors 62 and opening the apertures 59, 61 that it previously was blocking. This allows well fluid to flow through. The pins 63 on the upper side will not contact casing, thus each of the higher elevation restrictors 62 will remain in blocking engagement with one aperture 59 and one aperture 61, inhibiting the flow of gas into intake housing 55.

The invention has significant advantages. The restrictor retards the entry of gas into the intake of the pump. Even if utilized with a gas separator, it will reduce the amount of gas flowing into the lower end of the pump. This improves the efficiency of the pump. The restrictor automatically opens certain of the apertures and closes others once the pump is in place, thus the operator needs no prior knowledge of the final orientation of the pump assembly.

While the invention has been shown in only three of its forms, it should be apparent to those skilled in the art that it is not so limited but susceptible to various changes without departing from the scope of the invention.

What is claimed is:

1. An intake assembly for restricting gas entry into a pump located in a horizontal portion of a well, comprising:

a tubular housing having a plurality of apertures for receiving flow of well fluid, the apertures being spaced circumferentially around the housing so that once installed in the well, at least one lower elevation aperture and one higher elevation aperture are defined; and at least one movable restrictor located within the housing that at least partially blocks the higher elevation aperture and opens the lower elevation aperture to allow liquid to flow in the lower elevation aperture and restrict entry of gas into the higher elevation aperture.

2. The intake assembly according to claim 1, wherein the restrictor moves out of blocking engagement with the lower elevation aperture and into engagement with the higher elevation aperture automatically during installation of the pump and in response to the orientation of the pump.

3. The intake assembly according to claim 1, wherein the restrictor is buoyant in the well fluid, the buoyancy causing the restrictor to rise into at least partial blocking engagement with the higher elevation aperture.

4. The intake assembly according to claim 1, wherein the restrictor moves out of at least partial engagement with the lower elevation aperture in response to the housing coming into contact with a lower sidewall of the well.

5. The intake assembly according to claim 1, wherein:

the apertures are elongated in a direction parallel with a longitudinal axis of the intake assembly; and the restrictor comprises a helical coil that is buoyant, the coil having an axis that is parallel with the axis of the intake assembly.

6. The intake assembly according to claim 1, wherein:

the restrictor has at least one pin that protrudes through a hole in the housing while the restrictor is in a blocking position and is biased radially outward relative to a longitudinal axis of the housing, the restrictor at least partially blocking the aperture while the pin is protruding outward from the housing; and contact of the pin with a low side of the well causes the pin to move inward, opening the aperture.

7. The intake assembly according to claim 1, wherein:

the restrictor comprises a flexible elastomeric member.

8. The intake assembly according to claim 1, wherein the restrictor comprises:

a flexible sleeve biased into contact with an inner side of the housing to thereby block the apertures; and a plurality of pins protruding outward from holes in the sleeve that are spaced circumferentially around the housing, wherein when one of the pins contacts a lower side of the well, the sleeve deflects inward to open the lower elevation aperture.

9. The intake assembly according to claim 1, wherein:

said at least one restrictor comprises a plurality of flexible strips, each of the strips overlying at least one of the apertures and being secured to an inner wall of the housing at opposite ends of the strip; and a pin mounted to each of the strips intermediate the ends, the pin protruding outward through a hole in the housing while the restrictor is in a blocking position, the pin moving inward in response to contacting a lower side of the well to move an intermediate portion of the strip away from blocking engagement with the aperture.

10. An apparatus for pumping well fluid from a horizontal portion of a well, comprising:

a pump;

a submersible power source connected to the pump by a shaft for driving the pump;

the pump having an intake section that includes a tubular housing having a plurality of apertures for receiving flow of well fluid, the apertures being spaced circumferentially around the housing, the intake section adapted to be positioned in the horizontal portion of the well; and a buoyant restrictor located within the housing for floating upward in the well fluid to a restricting position at least partially blocking at least one of the apertures to restrict the entry of gas from the well fluid.

11. The apparatus according to claim 10, wherein the restrictor encircles the shaft, and while in the restricting position, a lower side of the restrictor is spaced from at least one other of the apertures to the well fluid.

12. The apparatus according to claim 10, wherein the restrictor has a helical, coiled configuration with an axis that is parallel to an axis of the shaft.

13. The apparatus according to claim 10, wherein:

the apertures are elongated in a direction parallel with the shaft;

the restrictor comprises a coil encircling the shaft and having a plurality of turns; and while in the restricted position, a plurality of the turns engage an inner surface of the housing and overlie said at least one of the apertures.

14. An apparatus for pumping well fluid from a horizontal portion of a well, comprising:

a pump;

a submersible power source connected to the pump by a shaft for driving the pump;

the pump having an intake section that includes a tubular housing having a plurality of apertures for receiving flow of well fluid, the apertures being spaced circumferentially around the housing;

at least one flexible restrictor located within the housing and biased against an inner wall of the housing to overlie and at least partially block at least one of the apertures while in a restricting position to restrict a flow of gas into the housing; and at least one pin extending from the restrictor through a hole provided in the housing, the pin adapted to contact a lower side of the well to push at least a portion of the restrictor inward from the restricted position to an open position allow the flow of well fluid into the housing.

15. The apparatus according to claim 14, wherein the restrictor comprises an elastomeric sleeve that encircles the shaft.

16. The apparatus according to claim 14, wherein:

the restrictor comprises a sleeve that encircles the shaft;

said at least one pin comprises a plurality of the pins located adjacent opposite ends of the sleeve; and wherein the sleeve has a plurality of slots spaced circumferentially around the sleeve, but offset from the apertures to enable well fluid to flow into the sleeve from the portion of the sleeve that is in the open position.

17. A method for restricting gas entry into a pump located in a horizontal portion of a well, comprising:

(a) providing the pump with a tubular housing having a plurality of apertures, the apertures being spaced circumferentially around the housing;

(b) installing at least one restrictor within the housing; then (c) lowering the pump into a horizontal portion of the well, resulting in at least one of the apertures being a higher elevation aperture and another of the apertures being a lower elevation aperture; and (d) causing the restrictor to at least partially block the higher elevation aperture to restrict entry of gas and open the lower elevation aperture to allow entry of liquid well fluid.

18. The method according to claim 17 wherein:

step (b) comprises making the restrictor buoyant; and step (d) occurs due to the restrictor floating upward into contact with a higher side of the housing.

19. The method according to claim 17 wherein:

step (b) comprises initially blocking all of the apertures with said at least one restrictor; and step (d) occurs due to contact of the housing with a low side of the casing causing at least part of said at least one restrictor to move inward from the lower elevation aperture.

* * * * *

UNITED STATES PATENT AND TRADEMARK OFFICE

CERTIFICATE OF CORRECTION

PATENT NO. : 6,715,556 B2
DATED : April 6, 2004
INVENTOR(S) : John J. Mack et al.

It is certified that error appears in the above-identified patent and that said Letters Patent is hereby corrected as shown below:

Column 6,
Line 67, insert -- to -- after "position"

Signed and Sealed this

Seventh Day of September, 2004

JON W. DUDAS
*Director of the United States Patent and Trademark Office*